US010947979B2

(12) United States Patent
Burke et al.

(10) Patent No.: US 10,947,979 B2
(45) Date of Patent: Mar. 16, 2021

(54) SHREDDING ASSEMBLY FOR A GRINDER PUMP AND CENTRIFUGAL GRINDER PUMP

(71) Applicant: Sulzer Management AG, Winterthur (CH)

(72) Inventors: Michael Burke, Wexford (IE); Barry McDonald, Wexford (IE); Abdulaleem Albadawi, Waterford (IE)

(73) Assignee: SULZER MANAGEMENT AG, Winterthur (CH)

( * ) Notice: Subject to any disclaimer, the term of this patent is extended or adjusted under 35 U.S.C. 154(b) by 145 days.

(21) Appl. No.: 16/184,387

(22) Filed: Nov. 8, 2018

(65) Prior Publication Data

US 2019/0170145 A1 Jun. 6, 2019

(30) Foreign Application Priority Data

Dec. 4, 2017 (EP) ..... 17205075

(51) Int. Cl.
*F04D 7/00* (2006.01)
*F04D 7/04* (2006.01)
(Continued)

(52) U.S. Cl.
CPC ..... *F04D 7/045* (2013.01); *B02C 18/0092* (2013.01); *B02C 18/2225* (2013.01);
(Continued)

(58) Field of Classification Search
CPC ..... F04D 7/045; F04D 13/08; F04D 1/063; F04C 2/00; B02C 18/0092; B02C 18/2225
See application file for complete search history.

(56) References Cited

U.S. PATENT DOCUMENTS 3,650,481 A 3/1972 Conery et al.
4,108,386 A * 8/1978 Conery ..... B02C 18/0092 241/185.6
(Continued)

FOREIGN PATENT DOCUMENTS

DE 19543916 A1 5/1996
JP S63235690 A 9/1988

OTHER PUBLICATIONS

Extended European Search Report dated Jun. 6, 2018 in corresponding European Patent Application No. 17205075.9, filed Dec. 4, 2017.

*Primary Examiner* — Faye Francis
(74) *Attorney, Agent, or Firm* — Global IP Counselors, LLP

(57) ABSTRACT

A shredding assembly for a grinder pump includes a stationary shredding ring mounted to an inlet of the pump, and a cutting device rotatable about an axial direction and fixed to a shaft of the pump. The shredding ring includes a top face, a bottom face, and a central opening extending from the top face to the bottom face and delimited in a radial direction by an inner periphery. Slots extending in the axial direction are formed in the inner periphery. The cutting device is positioned in the central opening of the shredding ring, and includes a front face and a back face. The front face includes a plurality of first cutting members extending in the axial direction and facing the slots. The back face includes a second cutting member projecting beyond the central opening with respect to the radial direction.

18 Claims, 4 Drawing Sheets

(51) Int. Cl.

| | |
|---|---|
| ***F04D 13/08*** | (2006.01) |
| ***B02C 18/00*** | (2006.01) |
| ***B02C 18/22*** | (2006.01) |
| ***F04D 1/06*** | (2006.01) |

(52) U.S. Cl.
CPC ..... *F04D 1/063* (2013.01); *F04D 13/08* (2013.01); *F05D 2250/294* (2013.01); *F05D 2260/607* (2013.01)

(56) References Cited

U.S. PATENT DOCUMENTS 4,911,368 A * 3/1990 Nishimori ..... F04D 7/045 241/46.017
5,016,825 A * 5/1991 Carpenter ..... F04D 7/045 241/258
7,159,806 B1 1/2007 Ritsema
7,237,736 B1 * 7/2007 Martin ..... F04D 7/045 241/185.6
7,357,341 B2 4/2008 Gutwein et al.
7,841,826 B1 * 11/2010 Phillips ..... F04D 7/045 415/121.1
7,841,827 B2 * 11/2010 Keener ..... F04D 29/2288 415/121.1
8,109,714 B2 * 2/2012 Keener ..... F04D 7/045 415/121.1
8,657,564 B2 * 2/2014 Cuppetelli ..... F04D 29/2288 415/121.1
9,039,356 B1 * 5/2015 Nowitzki ..... F04D 29/54 415/169.1
10,316,846 B2 * 6/2019 Davis ..... F04D 29/4293
2009/0067992 A1 * 3/2009 Keener ..... F04D 29/2288 415/121.1
2013/0121811 A1 * 5/2013 Cuppetelli ..... F04D 29/2288 415/121.1
2014/0199165 A1 * 7/2014 Pohler ..... F04D 7/045 415/204
2014/0263788 A1 9/2014 Vallen et al.

* cited by examiner

SHREDDING ASSEMBLY FOR A GRINDER PUMP AND CENTRIFUGAL GRINDER PUMP

CROSS-REFERENCE TO RELATED APPLICATION

This application claims priority to European Application No. 17205075.9, filed Dec. 4, 2017, the contents of which are hereby incorporated herein by reference.

FIELD OF THE INVENTION

The invention relates to a shredding assembly for a grinder pump and a centrifugal grinder pump.

BACKGROUND OF THE INVENTION

When conveying sewage or waste water and in particular of domestic waste water, problems result because such liquids contain constituents such as fibrous materials, rags, cloths, textiles, plastic bags or other solids, which can very easily become stuck in the region of the pump and can then result in a reduction in the efficiency, in particular the hydraulic efficiency, of the pump up to the complete blocking of the impeller of the pump. This can cause servicing or also complex and/or expensive maintenance work. Therefore, special measures have to be taken with such pumps in order to effectively prevent clogging.

A known solution to address this problem are centrifugal grinder pumps that are also referred to as centrifugal macerator pumps. These pumps include a rotating shredding assembly, also referred to as grinder, at the pump inlet for grinding the constituents in the sewage. Typically, the shredding assembly is performed with a cutting device rotating in or at the pump inlet for disintegrating or shredding the solid constituents in the sewage and thus preventing a clogging of the pump impeller.

SUMMARY

Quite often residential but also industrial sewer systems are only based upon gravity to discharge the sewage to larger reservoirs or treatment plants. However, if gravity is not sufficient to move the sewage to the desired location or if gravity based systems are not economical, grinder pumps are used to lift the sewage or to convey the sewage over longer distances. To this end grinder pumps are integrated for example in residential pressure sewerage systems (PPS) or gravity sewerage systems to provide an effective and economical dewatering. Usually grinder pumps use quite small-diameter discharge lines in all applications, such as in the private or municipal or industrial area.

Centrifugal grinder pumps may be designed as submersible pumps, i.e. as pumps that are configured to operate even if they are completely submerged and covered by the fluid to be conveyed.

A critical parameter of sewage pumps is the head-flow range in which they can be operated. In some applications the required head is very high, for example for lifting the sewage a head of up to 200 ft (61 m) or even more may be required. Such a high head in combination with a reasonable flow rate is at least very difficult if not impossible to realize with a centrifugal grinder pump having only one impeller. Therefore two stage centrifugal grinder pumps having two impellers arranged in series have been developed to increase the available head of the sewage pump (see for example U.S. Pat. No. 7,357,341).

Regarding the shredding assembly at the pump inlet, many different designs are known in the art. In U.S. Pat. No. 7,159,806, for example, a cutting assembly is disclosed comprising a rotary cutter rotatable in front of and cooperating with a plate cutter. The outer cutter surface of the stationary plate cutter comprises a plurality of entry openings having V-slice cutting edges. The rotary cutter comprises cutting blades which are rotated along the outer cutter surface of the plate cutter to provide a shearing action against the V-slice cutting edges. This design, in which the cutting or shearing action is realized between the rotating blades and the outer cutter surface of the stationary plate cutter is also referred to as front face or axial cutting because the rotary cutter is rotating in front of the cutter surface of the stationary plate cutter.

A different design of a shredding assembly is disclosed for example in U.S. Pat. No. 7,357,341. According to this design, the shredding assembly comprises a rotating cutter positioned within a stationary shredding ring. The rotating cutter includes a plurality of cutters and has a plurality of slots formed in the outer periphery of the rotating cutter. The stationary shredding ring has a plurality of channels formed in the inner periphery of the stationary shredding ring. In addition to the comminuting action of the cutters, additional shredding takes place between the slots and the channels. This design, in which the cutting or shearing action takes place between the outer periphery of the rotating cutter and the inner periphery of the stationary shredding ring, is also referred to as side wall or radial cutting.

However, the cutting or shredding action of these known designs is not always sufficient to ensure a proper operation of the grinder pump without the risk of the pump blocking or without a considerable reduction in the hydraulic efficiency of the pump. This applies in particular for grinder pumps, which are multistage pumps, for example as two stage pumps with two impellers arranged in series. In addition to the risk of blocking of one of the impellers there is also the likelihood that the transition from the first stage (first impeller) to the second stage (second impeller) is clogged by solid constituents in the liquid that are not sufficiently disintegrated by the shredding assembly. The transition from the first to the second stage may be designed, for example, as a diffusor having a plurality of internal channels. Thus, in case the solid material in the liquid is not sufficiently comminuted there is considerable risk that the diffusor is clogged.

Starting from this state of the art it is therefore an object of the invention to propose a different and very efficient shredding assembly for a grinder pump, which generates very finely shredded material to reliably avoid any clogging of the grinder pump. In particular, the shredding device shall be suited for a multistage grinder pump. In addition, it is an object of the invention to propose a centrifugal grinder pump having such a shredding assembly. The subject matter of the invention satisfying these objects is characterized by the features described herein.

Thus, according to the invention a shredding assembly for a grinder pump is proposed, comprising a stationary shredding ring configured for being mounted to an inlet of the pump, and a cutting device for rotating about an axial direction and configured for being fixed to a shaft of the pump, wherein the shredding ring comprises a top face, a bottom face, and a central opening extending from the top face to the bottom face and being delimited in the radial direction by an inner periphery, wherein a plurality of slots extending in the axial direction is formed in the inner periphery, wherein the cutting device is positioned in the central opening of the shredding ring, and comprises a front face and a back face, and wherein the front face comprises a plurality of first cutting members extending in the axial direction and facing the slots in the inner periphery, and wherein the back face of the cutting device comprises at least one second cutting member, with the second cutting member projecting beyond the central opening with respect to the radial direction.

By this configuration dual shredding action is achieved which results in a much finer shredded material, whereby a clogging of the grinder pump is reliably prevented. The first shredding action taking place between the first cutting members and the inner periphery of the central opening of the stationary shredding ring including the slots is a side wall or radial cutting action. The second shredding action taking place between the at least one second cutting member and the bottom face of the stationary shredding ring is an axial or back face cutting action. Since the second cutting member at the back face of the cutting device projects beyond the central opening with respect to the radial direction, i.e. the second cutting member overlaps with the bottom face of the stationary shredding ring in radial direction, any solid material passing through the slots in the inner periphery of the central opening is additionally comminuted between the second cutting member and the bottom face of the stationary shredding ring. By this dual shredding action the solid constituents in the liquid are very finely shredded.

Preferably the first cutting members are configured to fit into the central opening of the shredding ring. Thus, the maximum extension of the first cutting members, or the front face of the cutting device, respectively, is smaller than the inner diameter of the central opening of the shredding ring, so that the first cutting members may freely rotate within the central opening.

In order to improve the second shredding action at the bottom face of the stationary shredding ring it may be advantageous, when the back face of the cutting device comprises at least two and at most four second cutting members.

According to a preferred embodiment, the back face of the cutting device comprises exactly two second cutting members with the two second cutting members being arranged diametrically opposite at an outer periphery of the cutting device. By arranging two second cutting members at diametric positions of the cutting device a particularly good balance of the cutting device is achieved during rotation. Furthermore, for most applications two second cutting members on the one hand are sufficient to achieve a very fine shredding of the solid material, and on the other hand do not constitute a large additional flow restriction for the fluid passing the shredding assembly.

In view of a particularly effective second shredding action it is a preferred measure that each second cutting member projects beyond the slots of the inner periphery with respect to the radial direction.

It is a further advantageous measure regarding the second shredding action, when each second cutting member comprises a leading face being inclined with respect to the axial direction at a rake angle of 40° to 60°, preferably 45° to 55°, and even more preferred approximately 50°. When viewed in the direction of rotation of the cutting device, the leading face is inclined backwards. By providing this rake angle it is ensured that the solid material is guided away from the second cutting members and directed towards the first stage impeller of the pump.

Furthermore, it is a preferred design, that each second cutting member comprises a leading edge being inclined with respect to the radial direction at a cutting angle of 35° to 55°, preferably 40° to 50°, and even more preferred approximately 45°. When viewed in the direction of rotation, the leading edge is inclined backwards with respect to the radial direction, i.e. the radially inner end of the leading edge is ahead of the radially outer end of the leading edge. The leading edge inclined at the cutting angle is in particular advantageous to achieve a clean cut and a particularly fine shredding action of the solid material.

According to a preferred embodiment the slots are designed and arranged such, that only one of the two second cutting members performs a cutting action at any moment in time during operation. This may be realized by choosing the number of slots and the distance between adjacent slots such that the leading edge of the one of the second cutting members reaches the beginning of an individual slot only then, when the leading edge of the other of the second cutting members passes the end of another individual slot.

The design with only one of the second cutting members cutting at any moment in time ensures that the maximum torque available is given to that respective second cutting member which is just performing a cutting action. This measure is particularly advantageous, if there is only a low power or torque available for operating the grinder pump, e.g. if the grinder pump is operated with a single phase electric motor.

Regarding the first cutting members it is a preferred design, that the plurality of first cutting members comprises at least one recess at the outer periphery of the cutting device, the recess forming a cutting edge. Each recess extends in the axial direction, i.e. in the outer periphery of the cutting device, and into the front face of the cutting device. Thus, each recess forms a groove arranged in the front face and at the outer periphery of the cutting device with the respective edges delimiting the groove constituting cutting edges to provide the first shredding action between the outer periphery of the cutting device and the inner periphery of the central opening in the stationary shredding ring, or the slots formed in the inner periphery of the central opening, respectively.

Alternatively or additionally, the plurality of first cutting members comprises at least one protrusion extending from the front face of the cutting device in the axial direction. With respect to the radial direction the protrusion does not project beyond the outer periphery of the cutting device. Each protrusion has at least one edge for providing or contributing to the first shredding action between the rotating cutting device and the inner periphery of the central opening in the stationary shredding ring, or the slots formed in the inner periphery of the central opening, respectively.

According to a particularly preferred embodiment the plurality of first cutting members comprises both recesses and protrusions.

In a preferred embodiment each protrusion comprises a leading face being inclined with respect to the radial direction at a front angle of 18° to 28°, preferably 20° to 26°, and even more preferred approximately 23°. When viewed in the direction of rotation, the leading face of the protrusion is inclined such that the radially outer edge delimiting the leading face is ahead of the radially inner edge delimiting the leading face.

The radially outer surface delimiting the protrusion with respect to the radial direction is aligned with the outer periphery of the cutting device in the region where said outer surface abuts the leading face of the protrusion, i.e. in said region the radially outer surface of the protrusion is flush with the outer periphery of the cutting device.

Towards the trailing end of the protrusion the radially outer surface of the protrusion is no longer flush with the outer periphery of the cutting device, but is inclined radially inwardly at a recess angle δ. This measure is advantageous to avoid that any solid material is jammed between the cutting device and the shredding ring.

Furthermore, according to the invention, a centrifugal grinder pump is proposed, comprising a housing with an pump inlet for a fluid to be conveyed, and a pump outlet for discharging the fluid, further comprising at least one impeller for rotating about an axial direction with the impeller being arranged in an impeller chamber, a shaft for rotating the impeller, and a shredding assembly arranged at the pump inlet for shredding constituents of the fluid, wherein the shredding assembly is designed according to the invention, wherein the shredding ring is mounted to the inlet of the pump, wherein the cutting device is connected to the shaft in a torque-proof manner, and wherein the bottom face of the shredding ring and the back face of the cutting device are arranged to face the impeller chamber.

Thus, the shredding assembly is arranged in such a manner at the inlet of the grinder pump that both the bottom face of the stationary shredding ring and the back face of the cutting device with the second cutting member(s) are facing the impeller in the impeller chamber and the top face of the shredding ring as well as the front face of the cutting device are facing away from the impeller, i.e. the top face and the front face are facing the fluid entering the grinder pump.

By the dual shredding action according to the invention the grinder pump is reliably prevented from clogging.

According to a preferred embodiment the centrifugal grinder pump is a multistage centrifugal pump comprising two impellers and two impeller chambers, namely a first stage impeller arranged in a first impeller chamber, and a second stage impeller arranged in a second impeller chamber, and further comprising a diffusor for guiding the fluid from the first impeller chamber to the second stage impeller with the diffusor being arranged between the first stage impeller and the second stage impeller regarding the axial direction, wherein the first stage impeller and the second stage impeller are connected to the shaft in a torque-proof manner.

By providing the centrifugal grinder pump with two impellers arranged in series, i.e. one after the other with respect to the axial direction, the head-flow range, in which the pump may be operated, is considerably extended as compared to pumps with only one impeller. In particular, the head that can be generated with the multistage centrifugal grinder pump is remarkably increased, so that the multistage grinder pump is particularly suited for high head applications requiring a head of, for example, up to 200 feet (61 meters) or even more. In addition, since the centrifugal grinder pump is preferably designed with an internal diffusor for guiding the fluid conveyed by the first stage impeller from the first impeller chamber to the second stage impeller, the grinder pump is very compact, because there is no need for an interstage conduit arranged at the outside of the housing and wrapping around the housing.

It is a preferred measure, that the diffusor is designed as a disk-shaped diffusor delimiting both the first impeller chamber and the second impeller chamber with respect to the axial direction.

The disk-shaped diffusor, which is arranged—regarding the axial direction—between the first impeller chamber with the first stage impeller and the second impeller chamber with the second stage impeller, directs the fluid by a plurality of internal channels disposed within the diffusor, so that there is no need for an interstage conduit at the outside of the housing.

According to a preferred embodiment, the centrifugal grinder pump comprises a drive unit for rotating the shaft about the axial direction, wherein the drive unit is arranged within the housing, and wherein the first stage impeller and the second stage impeller are arranged between the drive unit and the shredding assembly with respect to the axial direction.

It is a very compact design to arrange the drive unit within the housing of the pump. Of course, the housing may be designed to comprise two or more housing parts that are assembled and firmly fixed with respect to each other, e.g. by screws or bolts, to form the housing of the pump.

Most preferred, the centrifugal grinder pump is designed for a vertical operation with the shaft extending in the vertical direction, wherein the drive unit is arranged above the first stage impeller and the second stage impeller. During operation the shaft is oriented in the direction of gravity and the axial direction extends vertically. In this configuration the pump inlet with the shredding assembly is located at the bottom of the pump, the first stage impeller is arranged above the shredding assembly, the second stage impeller is arranged above the first stage impeller and the drive unit is positioned on top of the second stage impeller. The shaft is extending vertically from the drive unit to the shredding assembly for rotating the first and the second stage impeller as well as the cutting device of the shredding assembly about the axial direction.

In particular for sewage and dewatering applications it is preferred that the pump is a submersible pump.

According to a particularly preferred embodiment the centrifugal grinder pump is configured as a two stage pump having exactly two impellers, namely the first stage impeller and the second stage impeller.

However it is also possible to configure the centrifugal grinder pump according to the invention with only one stage (single stage pump) or with three or even more stages, wherein the number of stages equals the number of impellers that are provided in the pump. Further advantageous measures and embodiments of the invention will become apparent from the description herein.

BRIEF DESCRIPTION OF THE DRAWINGS

The invention will be explained in more detail hereinafter with reference to the drawings.

DETAILED DESCRIPTION OF THE EMBODIMENTS

Figure 1:
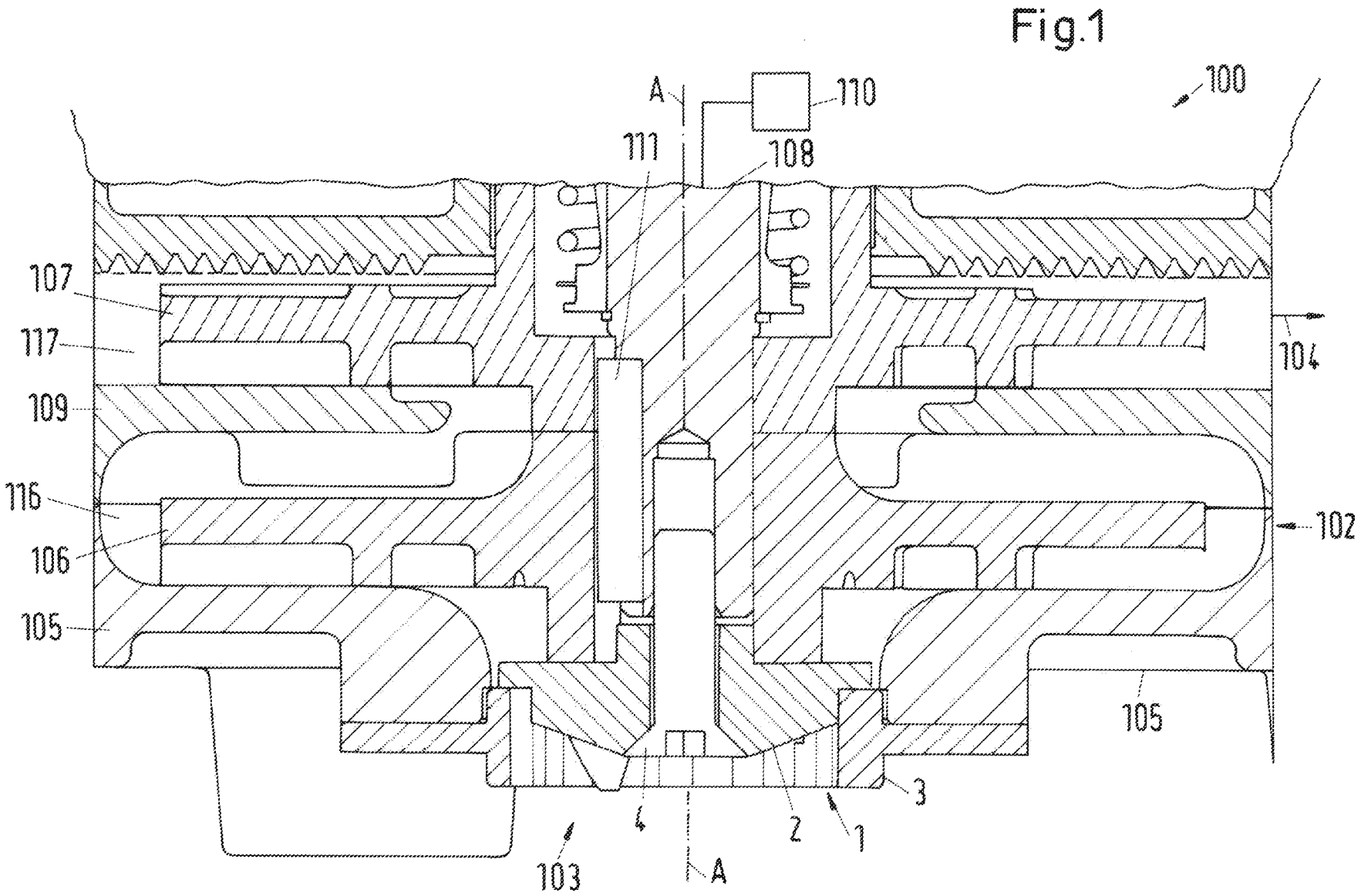
FIG. 1 is a cross-sectional view of an embodiment of a centrifugal grinder pump according to the invention.

FIG. 1 shows a cross-sectional view of an embodiment of a centrifugal grinder pump according to the invention comprising an embodiment of a shredding device. The centrifugal grinder pump is designated in its entity with reference numeral 100, and the shredding device is designated in its entity with reference numeral 1.

In the following description reference is made by way of example to an embodiment of the centrifugal grinder pump 100, which is a multistage centrifugal pump, in particular a two stage pump. It goes without saying that the centrifugal grinder pump may also be a single stage grinder pump or as a multistage grinder pump having more than two stages, for example three stages or even more. Furthermore, reference is made by way of example to the important application that the centrifugal grinder pump is used for conveying sewage or wastewater in private, municipal or industrial areas. The sewage typically comprises solid constituents such as fibrous materials, rags, cloths, textiles, paper, plastic bags or other solids.

FIG. 1 shows—partially in a schematic manner—important parts, in particular the hydraulic section of the multistage centrifugal grinder pump 100. This embodiment is a two stage pump 100. The pump 100 comprises a housing 102 (partially shown) and a drive unit 110 for driving the pump 100. The housing 102 may comprise several housing parts, which are connected to each other to form the housing 102 of the pump 100. In addition, the drive unit 110 is also arranged within the housing 102. The centrifugal grinder pump 100 is a submersible pump 100, which can be operated also, when the pump 100 is partially or completely submerged in a liquid, e.g. the sewage or the wastewater that shall be conveyed by the pump 100.

The housing 102 has a pump inlet 103 for a fluid to be conveyed and a pump outlet 104 for discharging the fluid. The pump outlet is not shown in detail but indicated by the arrow with the reference numeral 104. The fluid is for example sewage or wastewater comprising beside water also solid constituents as mentioned before. As it is typical for a centrifugal grinder pump 100, the shredding assembly 1 is arranged at the pump inlet 103, so that the fluid can only enter the pump 100 by passing the shredding assembly 1.

Figure 2:
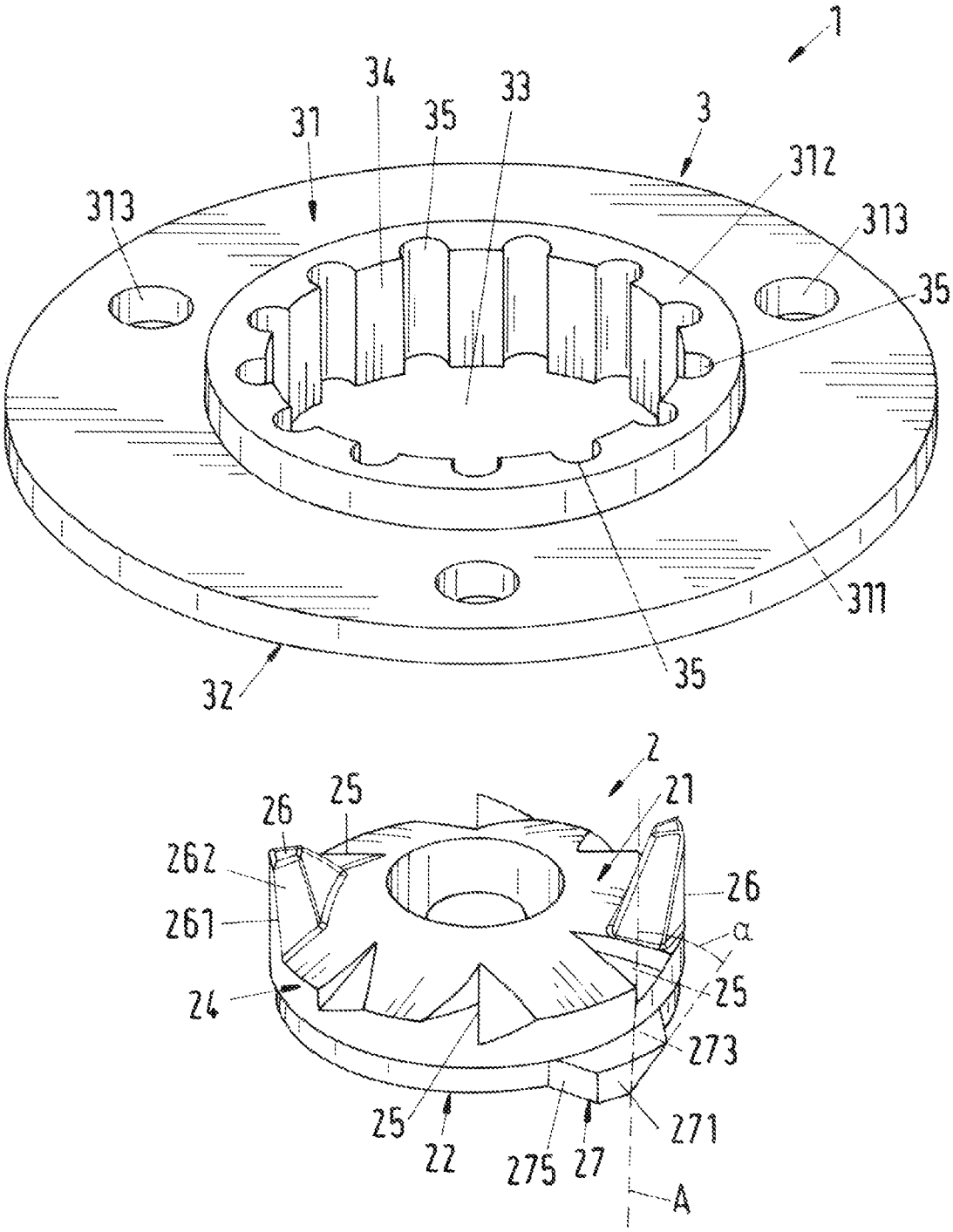
FIG. 2 is an exploded perspective view of an embodiment of a shredding assembly according to the invention.
Figure 3:
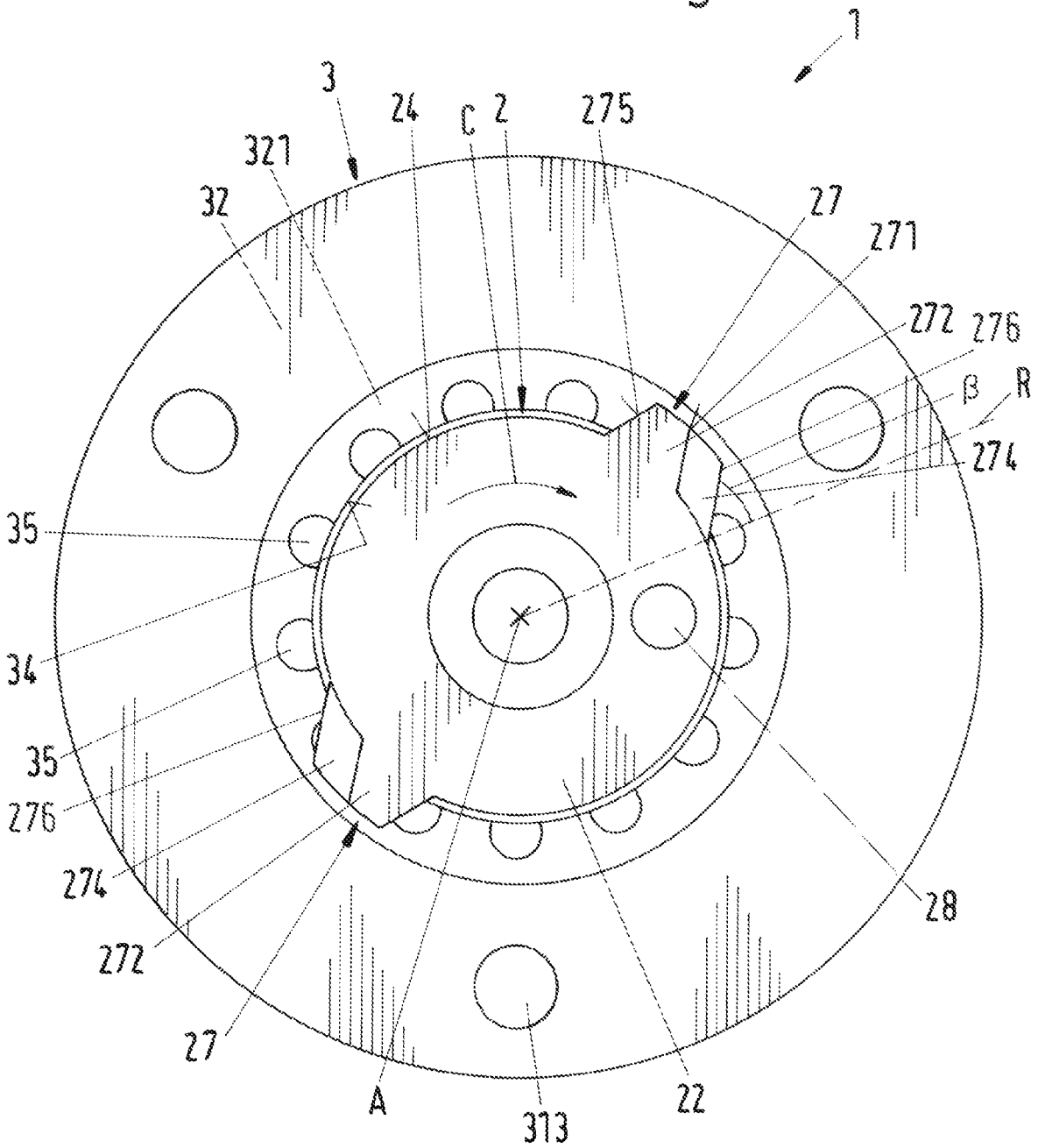
FIG. 3 is a bottom view of the shredding assembly as seen from the first stage impeller.
Figure 4:
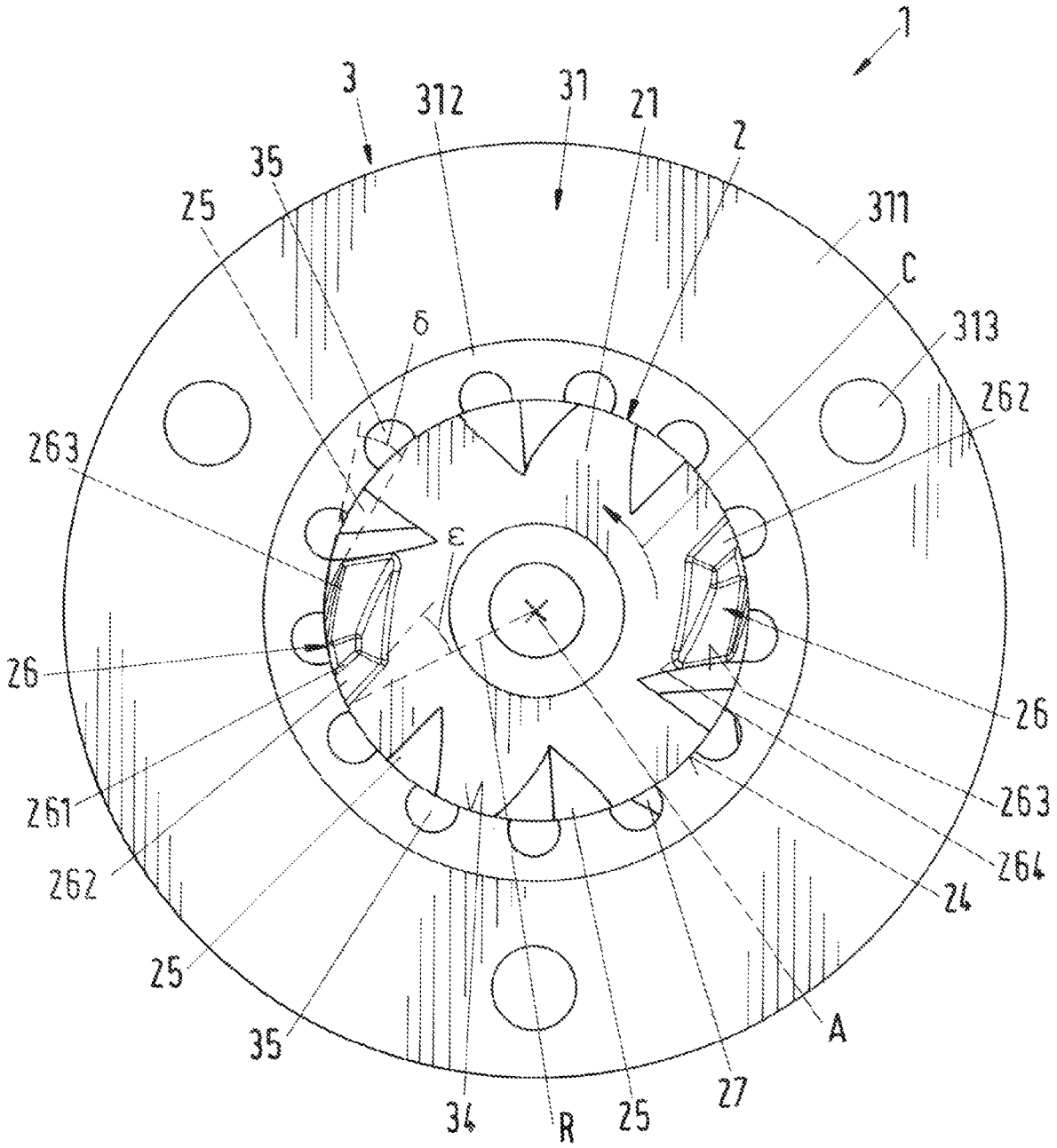
FIG. 4 is a top view of the shredding assembly as seen in a view from outside the pump towards the pump inlet.

The shredding assembly 1 is shown in more detail in FIG. 2-4, wherein FIG. 2 shows an exploded perspective view of the shredding assembly 1, FIG. 3 shows a bottom view of the shredding assembly 1 as seen from the inside of the pump housing 102 when looking towards the pump inlet 103, and FIG. 4 shows a top view of the shredding assembly 1 as seen from the outside of the pump housing 102 when looking towards the pump inlet 103.

The shredding assembly 1 comprises a stationary shredding ring 3 mounted to the pump housing 102, more precisely to a base plate 105 of the pump housing 102. The shredding ring 3 may be fixed to the base plate 105 by screws or bolts (not shown). The base plate 105 is also referred to as wear plate. The shredding assembly 1 further comprises a cutting device 2 rotating during operation about an axial direction A for shredding or disintegrating the solid constituents of the sewage so that they cannot clog the pump 100. The shredding assembly 1, which is also referred to as grinder or macerator, will be described in more detail hereinafter.

The centrifugal grinder pump 100 further comprises two impellers 106, 107 arranged in series for acting on the fluid, namely a first stage impeller 106 located in a first impeller chamber 116 and a second stage impeller 107 located in a second impeller chamber 117. During operation both impellers 106, 107 rotate about the same rotational axis, which defines the axial direction A. For driving the rotation of the impellers 106, 107 as well as the rotation of the cutting device 2 a shaft 108 is provided extending in the axial direction A. The shaft 8 is coupled to the drive unit 110 (schematically shown in FIG. 1), which rotates the shaft 108 about the axial direction A. Thus, the longitudinal axis of the shaft 108 coincides with the rotational axis and therefore defines the axial direction A.

A direction perpendicular to the axial direction A is referred to as 'radial direction'. The term 'axial' or 'axially' is used with the common meaning 'in axial direction' or 'with respect to the axial direction'. In an analogous manner the term 'radial' or 'radially' is used with the common meaning 'in radial direction' or 'with respect to the radial direction'.

The two stage centrifugal grinder pump 100 is designed for a vertical operation with the shaft 108 extending in the vertical direction, i.e. the direction of gravity. Hereinafter relative terms regarding the location like "above" or "below" or "upper" or "lower" refer to the usual operating position of the pump 100. FIG. 1 shows the centrifugal grinder pump 100 in its usual operating position.

The drive unit 110 is arranged on top of the impellers 106, 107, i.e. above the first and the second stage impeller 106, 107. Preferably, the drive unit 110 comprises an electric motor for driving the shaft 108. The electric motor may be configured in many different manners which are known in the art. In particular, the electric motor is designed or encapsulated in the housing 102 for being submerged.

As can be seen in FIG. 1 the pump inlet 103 with the shredding assembly 1 is centrally arranged at the bottom of the pump 100, so that the fluid can enter the pump 100 in a generally axial direction. The first stage impeller 106 is arranged adjacent to the pump inlet 103 and the shredding assembly 1 for receiving the fluid that passed through the shredding assembly 1. The second stage impeller 107 is arranged behind the first stage impeller 106 when viewed in the general flow direction of the fluid. The pump outlet 104 is arranged laterally at the housing 102 on the same height (regarding the axial direction A) as the second stage impeller 107. The first stage impeller 106 and the second stage impeller 107 are connected to the shaft 108 in a torque-proof manner, for example by a key lock 111. The shaft 108 extends from the drive unit 110 upwardly to the cutting device 2 of the shredding assembly 1. The cutting device 2 is fixed to the shaft 108, preferably in a torque-proof manner. As can be seen in FIG. 1 the cutting device 2 is mounted to the lower axial end of the shaft 108 and fixed thereto, e.g. by a centrally arranged screw 4. In addition, for transferring the torque from the shaft 108 to the cutting device 2 a drive pin (not shown) being fixed to or forming an integral part of the shaft 108 may be provided, wherein the drive pin engages with a bore 28 (FIG. 3) provided in the cutting device 2.

The centrally arranged screw 4 is preferably designed as a countersink bolt or counter sink screw, i.e. the centrally arranged recess in the cutting device 2, which receives the screw 4, as well as the head of the screw 4 are tapered. In addition, this recess is adapted to the screw 4 such, that the head of the screw 4 is flush with the surface of the cutting device 2. Both measures are advantageous to prevent ragging or toeing of material at the center of the cutting device.

Between the first stage impeller 106 and the second stage impeller 107 a static and essentially disk-shaped diffusor 109 is arranged to receive the fluid conveyed by the first stage impeller 106 and guiding the fluid to the second stage impeller 107.

Both the first impeller chamber 116 and the second impeller chamber 117 have an essentially circular cross-section perpendicular to the axial direction A. The diameter of the first and the second impeller chamber 116, 117 is in each case larger than the outer diameter of the respective first or second stage impeller 106, 107, so that there is an essentially annular flow channel between the radially outer end of the impellers 106, 107 and the wall delimiting the respective first or second impeller chamber 116, 117 in radial direction. Each flow channel surrounds the respective first or second stage impeller 106, 107.

Both the first and the second stage impeller 106, 107 are centered in the respective first and second impeller chamber 116, 117, meaning that the radial distance between the radially outer end of the respective impeller 106, 107 and the wall delimiting the respective first or second impeller chamber 116, 117 in radial direction is constant when viewed in the circumferential direction of the first or second stage impeller 106, 107, respectively. Thus, both the flow channel of the first impeller chamber 116 and the flow channel of the second impeller chamber 117 have a constant width in radial direction when viewed in the circumferential direction.

Both the first impeller chamber 116 and the second impeller chamber 117 are designed with a circular cross-section perpendicular to the axial direction A which renders the manufacturing simpler.

The disk-shaped diffusor 109 interposed between the first and the second stage impeller 106, 107 directs the fluid that has been acted on by the first stage impeller 106 to the second stage impeller 107, more precisely, the disc-shaped diffusor 109 guides the fluid from the flow channel of the first impeller chamber 116 to the radially inner region of the second stage impeller 107. At the same time the diffusor 109 transforms kinetic energy of the fluid into pressure, i.e. the velocity of the fluid is decreased and the pressure is increased.

The disk-shaped diffusor 109 is arranged concentrically with the first and the second stage impeller 106, 107, and fixed relative to the housing 102. The disk-shaped diffusor 109 is directly interposed between the first stage impeller 106 and the second stage impeller 107, so that the diffusor 109 delimits both the first impeller chamber 116 and the second impeller chamber 117 with respect to the axial direction A.

The bottom face of the disk-shaped diffusor 109 facing the first stage impeller 106 comprises one or more inlet openings arranged for receiving the fluid from the first impeller chamber 116, more precisely from the flow channel of the first impeller chamber 116.

The top face of the disk-shaped diffusor 109 facing the second stage impeller 107 comprises a plurality of outlet openings for supplying the fluid to the second stage impeller 107. The outlet openings are arranged considerably closer to the shaft 108 than the inlet opening(s), so that the fluid is supplied to the central region of the second stage impeller 107.

The disk-shaped diffusor 109 further comprises a plurality of internal channels with each internal channel extending from the inlet opening or one of the inlet openings through the interior of the disk-shaped diffusor 109 to one of the outlet openings. Preferably, the number of internal channels equals the number of outlet openings. Adjacent internal channels of the diffusor 109 are separated from each other by a respective stationary diffusor vane.

The fluid entering the internal channels of the diffusor 109 from the flow channel of the first impeller chamber 116 and through the inlet opening (s) is directed by the diffusor vanes radially inwardly towards the shaft 108 and diverted in the axial direction A, so that the fluid discharged through the outlet openings of the diffusor 109 flows generally in the axial direction A towards the second stage impeller 107.

Referring now in particular to FIG. 2-FIG. 4 the shredding assembly 1 will be explained in more detail.

The stationary shredding ring 3 configured for being mounted to the pump inlet 103 comprises a top face 31, a bottom face 32 and a central opening 33 extending from the top face 31 to the bottom face 32. When mounted to the base plate 105 of the pump housing 102 the top face 31 faces the outside of the pump 100 wherein the bottom face 32 faces the interior of the pump 100 (FIG. 1). The top face 32 comprises an annular outer region 311 and a flange-like annular inner region 312 protruding above the outer region 311 with respect to the axial direction A, such that a step is formed between the outer region 311 and the inner region 312. Both the inner region 312 and the outer region 311 are concentrically arranged with the central opening 33, wherein the inner region 312 delimits the central opening 33 with respect to the radial direction.

The protruding inner region 312 fits in a recess disposed in the base plate 105 of the pump housing (FIG. 1) and serves as a guidance for centering the shredding ring 3 with respect to the base plate 105.

The outer region 311 of the top face 31 includes a plurality, here three, holes 313 for receiving screws or bolts (not shown), with which the shredding ring 3 may be fixed to base plate 105 of the pump housing 102. The holes 313 are equidistantly distributed over the outer region 311 with respect to the circumferential direction.

The central opening 33 receives the cutting device 2 (FIG. 1). The central opening 33 is delimited with respect to the radial direction by an inner periphery 34. A plurality of slots 35 is formed in the inner periphery 34 with each slot 35 extending in the axial direction A from the top face 31 to the bottom face 32 of the shredding ring 3. In particular each slot 35 is aligned with respect to the axial direction A, i.e. the slots 35 are not slanted with respect to the axial direction A. Thus, when the shredding ring 3 is mounted to the pump housing 102, each slot 35 is vertically aligned. In addition, all slots 35 are arranged parallel to each other and all slots 35 are parallel to the axial direction A. In the described embodiment thirteen parallel slots 35 are arranged in the inner periphery of the central opening 33.

With respect to the radial direction, i.e. perpendicular to the axial direction A, each slot 35 has a cross-section being a part of a circle, for example a semicircle. The axially extending edges of the slots 35 serve as cutting edges for chopping the solid constituents of the fluid in a manner known as such.

Regarding the design of the stationary shredding ring 3 and in particular the design of the slots 35 in the inner periphery 34 there are many different possibilities, which are, as such, well-known in the art. Therefore, there is no need to describe or explain the stationary shredding ring 3 in more detail. Basically the shredding ring 3 may be configured according to any known design that is used for shredding or cutting systems in connection with pumps.

The cutting device 2 is configured to be positioned in the central opening 33 of the stationary shredding ring 3 and to be fixed to the shaft 108 of the pump 100. The cutting device 2 comprises a front face 21 and a back face 22 delimiting the cutting device 2 with respect to the axial direction A, as well as an outer periphery 24 delimiting the cutting device 2 with respect to the radial direction.

When the cutting device 2 is mounted to the shaft 108 of the pump 100 the front face 21 faces the outside of the pump 100, wherein the back face 22 faces the first impeller chamber 116 of the pump 100. Thus, the fluid enters the pump 100 from the front face 21 of the cutting device 2 and leaves the shredding assembly 1 at the back face 22 of the cutting device 2.

As can be best seen in FIG. 1 and FIG. 2 the front face 21 is designed in a generally tapered manner. The front face 21 is angled with respect to the radial direction, so that the solid material arriving at the front face 21 is guided away from the center of the cutting device 2 towards the slots 35 of the shredding ring 3.

The front face 21 of the cutting device 2 comprises a plurality of first cutting members 25, 26 extending in the axial direction A and facing the slots 35 in the inner periphery, when the cutting device 2 is inserted into the central opening 33 of the shredding ring 3.

The first cutting members 25, 26 provide a first shredding action taking place between the outer periphery 24 of the rotating cutting device 2 (or the first cutting members 25, 26, respectively) and the inner periphery 34 of the stationary shredding ring 3. This is also referred to as a side wall or radial shredding action.

The direction of the rotation of the cutting device 2 is indicated by the arrow with the reference numeral C.

The first cutting members 25, 26 comprise both recesses 25 at the outer periphery 24 extending into the front face 21 of the cutting device 2 as well as in the axial direction A, and protrusions 26 extending from the front face 21 of the cutting device 2 in the axial direction A away from the front face 21.

In the embodiment shown in particular in FIG. 2 and FIG. 4, there are provided two protrusions 26 and six recesses 25. The two protrusions 26 are arranged diametrically opposite at the outer periphery 24 and on the front face 21 of the cutting device 2. The protrusions 26 do not project beyond the outer periphery 24 with respect to the radial direction. Each protrusion 26 comprises a radially outer surface 263 delimiting the protrusion 26 with respect to the radial direction, as well as a leading face 262 and a trailing end 264 delimiting the protrusion 26 with respect to the circumferential direction of the cutting device 2. When viewed in the direction of the rotation C of the cutting device 2 the leading face 262 is arranged in front of the trailing end 264.

Each protrusion 26 comprises at least one axially extending cutting edge 261. The cutting edge 261 of the protrusion 26 is the edge, where the leading face 262 and the radially outer surface 263 about against each other.

Each protrusion 26 is designed with the leading face 262 of the protrusion 26 being slanted with respect to the radial direction R (FIG. 4). Thus, the leading face 262 does not extend exactly in the radial direction R, but is inclined with respect to the radial direction R at a front angle ε. The front angle ε is at least 18° and at most 28°. Preferably, the front angle ε is in the range from 20° to 26° and even more preferred, the front angle ε is approximately 23°. The inclination of the leading face 262 with respect to the radial direction R is such, that the radially outer edge delimiting the leading face 262, namely the cutting edge 261, is ahead of the radially inner edge delimiting the leading surface 262 when viewed in the direction of the rotation C.

At least in the region adjacent to the cutting edge 261 the radially outer surface 263 of the respective protrusion 26 is aligned with the outer periphery 24 of the cutting device 2. That is, the radially outer surface 263 of each protrusion 26 is flush with the outer periphery 24 of the cutting device 2 in the region adjacent to the cutting edge 261.

Towards the trailing end 264 of the protrusion 26 the radially outer surface 263 is no longer flush with the outer periphery 24 of the cutting device 2, but is inclined radially inwardly. As can be best seen in FIG. 4, adjacent to the cutting edge 261 the radially outer surface 263 is aligned with the outer periphery 24 with respect to the axial direction A. At the trailing end 264 of the protrusion 26 the radially outer surface 263 extends away from the outer periphery 24 in a generally inwardly direction regarding the radial direction. Thus, adjacent to the trailing end 264 the radially outer surface 263 is designed to include a recess angle δ with a tangent to the outer periphery 24 of the cutting device 2. The recess angle δ is at least 10° and at most 18°. Preferably, the recess angle δ is in the range from 12° to 16° and even more preferred, the recess angle δ is approximately 14°. The design of the radially outer surface 263 with the recess angle δ is advantageous for preventing that the solid material chopped between the cutting edge 261 and the respective cutting edge of the slots 35 becomes jammed between the cutting device 2 and the stationary shredding ring 3.

The six recesses 25 at the outer periphery 24 of the cutting device are equally distributed between the two protrusions 26. Each recess 25 extends from the outer periphery 24 of the cutting device 2 into the front face 21 and is generally V-shaped with the open side of the V being located at the outer periphery 24. The edges of the recesses 25 at the outer periphery form cutting edges in a manner known as such. As can be seen for example in FIG. 4 the recesses 25 do not need to have all the same shape. In this embodiment there are two types of recesses 25 having different shapes.

Of course the specific number of two protrusions 26 and six recesses 25 is by way of example only. In principle, it is also possible that there are provided only recesses 25 but no protrusions 26 or only protrusions 26 but no recesses 25. However, it is preferred that the first cutting members comprise at least one recess 25 and in addition at least one protrusion 26.

Regarding the specific design of the first cutting members 25, 26, for example with respect to the number of first cutting members 25, 26, the shape or the dimensions of the first cutting members 25, 26 there are many different embodiments possible and known in the art. Just as examples, reference is made to U.S. Pat. Nos. 4,108,386 and 5,016,825. Basically the first cutting members 25, 26 may be configured according to any known design that is used for a side wall or radial shredding action between the outer periphery 24 of the rotating cutting device 2 and the inner periphery 34 of the stationary shredding ring 3.

According to the invention, the back face 22 of the cutting device 2 comprises at least one second cutting member 27 with the second cutting member 27 projecting beyond the central opening 33 with respect to the radial direction (FIG. 3).

The embodiment of the cutting device 2 shown in FIG. 2-FIG. 4 comprises two second cutting members 27 as can be best seen in FIG. 3. The second cutting members 27 provide a second shredding action taking place between the second cutting members 27 and the bottom face 32 of the stationary shredding ring 3. This is also referred to as a back face or axial shredding action.

The two second cutting members 27 are arranged diametrically opposite at the back face 22 and at the outer periphery 24 of the cutting device 2. Each second cutting member 27 comprises a radially outer face 271 delimiting the second cutting member 27 with respect to the radial direction, a bottom face 272 and a top face 273, delimiting the second cutting member 27 with respect to the axial direction A, as well as a leading face 274 and a trailing face 275 delimiting the second cutting member 27 with respect to the circumferential direction of the cutting device 2. When viewed in the direction of the rotation C of the cutting device 2 the leading face 274 is arranged in front of the trailing face 275.

The second cutting member 27 further comprises a leading edge 276. The leading edge 276 is the edge, at which the leading face 274 and the top face 273 abut against each other. The leading edge 276 connecting the top face 273 with the leading face 274 of the secondary cutting member 27 constitutes a cutting edge for shredding the solid constituents of the fluid.

As can be best seen in FIG. 3 the respective bottom face 272 of each second cutting member 27 is flush with the back face 22 of the cutting device 2. The radial extension of the second cutting member 27, i.e. the radial distance of the radially outer surface 271 from the outer periphery 24 of the cutting device 2, determines the overlap of the second cutting member 27 with the bottom face 32 of the stationary shredding ring 3. Preferably, the radial extension of each second cutting member 27 is as large that the secondary cutting member 27 projects not only beyond the central opening 33 but also beyond the slots 35 in the inner periphery 34 of the central opening 33. Thus, during rotation of the cutting device 2 the second cutting member 27 completely covers a respective slot 35 when passing above said slot 35.

The bottom face 32 of the shredding ring 3 may include an annular recess 321 (FIG. 3) being arranged concentrically with the central bore 33 and having a diameter, which is measured such that the second cutting members 27 rotate within the annular recess 321.

During operation all solid constituents in the fluid that pass the first cutting members 25, 26 either without being shredded or without being sufficiently shredded will be (additionally) chopped by the second shredding action between the second cutting members 27 and the bottom face 32 of the shredding ring 3. In particular, the leading edge 276 between the leading face 274 and the top face 273 of the second cutting member 27 will shear or cut such solid constituents in cooperation with the bottom face 32 of the stationary shredding ring 3 and more precisely in cooperation with the edges delimiting the slots 35 in the bottom face 32.

In order to provide a very efficient second shredding action at the bottom face 32 of the shredding ring 3 it is preferred that the leading edge 276 of each second cutting member 27 is inclined with respect to the radial direction R at a cutting angle β (FIG. 3). Thus, the leading edge 276 does not extend exactly in the radial direction R, but is slanted with respect to the radial direction R such that the leading edge 276 and the radial direction R form the cutting angle β. When viewed in the direction of rotation C, the leading edge 276 is inclined backwards, meaning that the radially inner end of the leading edge 276 is ahead of the radially outer end of the leading edge 276. This inclination of the leading edge 276 of the second cutting member 27 relative to the radial direction is advantageous to achieve a clean cut and a fine shredding between the leading edge 276 and the slots 35 in the bottom face of the shredding ring 3.

For achieving an efficient second shredding action by the leading edge 276 it is advantageous, when the cutting angle β is at least 35° and at most 55°. Preferably, the cutting angle β is in the range from 40° to 50° and even more preferred, the cutting angle β is approximately 45°.

In order to efficiently direct the shredded material away from the respective second cutting member 27 and to guide the shredded material towards the first stage impeller 106, it is preferred, that the leading face 274 of each second cutting member 27 is inclined with respect to the axial direction A at a rake angle α. As shown in FIG. 2, the rake angle α is defined as the angle between the axial direction A and the leading face 274. In the assembled state of the centrifugal grinder pump 100 the rake angle α is the angle between the leading face 274 of the second cutting member 27 and the vertical direction (direction of gravity).

The rake angle α equals 90° minus the angle between the top face 273 and the leading face 274 of the second cutting member. Furthermore, the rake angle α equals 90° minus the angle at which the leading face 274 is inclined with respect to the radial direction.

When viewed in the direction of the rotation C, the leading face 274 is inclined backwards, that is the leading edge 276 is ahead of the edge connecting the leading face 274 and the bottom face 272 of the second cutting member 27. By this inclination the material shredded by the leading edge 276 slides along the leading face 274 and is directed towards the first stage impeller 106.

The leading face 274 may be designed with the rake angle α being at least 40° and at most 60°. Preferably, the rake angle α is in the range from 45° to 55° and even more preferred, the rake angle α is approximately 50°.

As a further preferred feature the slots 35 are designed and arranged such, that only one of the two second cutting members 27 performs a cutting action at any moment in time during operation of the centrifugal grinder pump. This feature may be realized by the number of slots 35 and/or by their dimension. Referring particularly to FIG. 3, the embodiment of a shredding assembly 1 comprises thirteen slots 35 in the inner periphery 34 of the central opening 33 of the shredding ring 3. Each slot 35 is aligned in the axial direction A. All slots 35 are parallel to each other and equidistantly distributed along the inner periphery 34 of the central opening. The cutting device 2 comprises exactly the two second cutting members 27 arranged diametrically opposite at the outer periphery 24 of the cutting device 2. This configuration is one example how to realize the preferred feature that only one of the two second cutting members 27 performs a cutting action at any moment, as will now be end of the slot 35, over which the leading edge 276 has passed, wherein "the end of the slot 35" refers to the circumferential direction. At the same time the upper of the second cutting members 27 (according to the representation in FIG. 3) is just going to start a cutting action, because its leading edge 276 just reaches the beginning of the slot 35, over which the leading edge 276 will pass, wherein "the beginning of the slot 35" refers to the circumferential direction.

Thus, it can be seen that at any moment in time during operation of the centrifugal grinder pump 100 it is always only one second cutting member 27 that performs a cutting action at the bottom face 32 of the shredding ring.

The configuration with only one of the second cutting members 27 cutting at any moment in time during operation ensures that the maximum torque available is provided to the respective second cutting member 27 for performing the cutting action. This is particularly advantageous for such embodiments of the grinder pump 100, where only a low torque and/or a low power is available for operating the pump, e.g. when the centrifugal grinder pump 100 is operated with a single phase motor as drive unit 110.

Furthermore, it is preferred to design the shredding assembly 1 such that there is only a very small clearance between the stationary shredding ring 3 and the rotating cutting device 2. There are two gaps providing a clearance, namely the gap in the axial direction A between the secondary cutting members 27 and the bottom face 32 of the shredding ring and the gap in radial direction between the protrusions 26 or the outer periphery 24 of the cutting device 2, respectively, and the inner periphery 34 of the shredding ring 3. Both gaps are preferably very tight to avoid that any solid material is jammed between the rotating parts 27, 26, 24 and the respective stationary parts 32, 34. It is particularly preferred, when each of said two gaps has a width that does not exceed 0.15 mm. Even more preferred each of said gaps has a width of approximately 0.1 mm.

During operation of the centrifugal grinder pump 100 the fluid, e.g. the sewage, enters the pump 100 through the pump inlet 103 and passes the shredding assembly 1 at the pump inlet 103. By the dual shredding action of the shredding assembly 1 all solid constituents in the sewage such as paper, rags, cloths and so on, are reliably shredded to such an extent that they will not clog the pump 100, e.g. block one of the impellers 106, 107 or clog the inner channels of the diffusor 109. After having passed the shredding assembly 1 the fluid flows into the first impeller chamber 116, where it is acted upon by the centrifugal first stage impeller 106. The first stage impeller 106 conveys the fluid to the flow channel of the first impeller chamber 116. From there the fluid enters the disk-shaped diffusor 109, is guided by the internal channels radially inwardly towards the shaft 108 and diverted into the axial direction A. The fluid is discharged from the diffusor 109 and enters the second impeller chamber 117 flowing essentially in the axial direction A towards the centrifugal second stage impeller 107. The second stage impeller 107 conveys the fluid into the flow channel of the second impeller chamber 117 from where the fluid is discharged through the pump outlet 104 of the pump 100.

It has to be understood that the invention is not restricted to embodiments of the pump with two pump stages. The shredding assembly 1 according to the invention may also be used in single stage grinder pumps having only one impeller or in grinder pumps comprising more than two stages, e.g. three or four or even more stages.

What is claimed:

1. A shredding assembly for a grinder pump, comprising:

a stationary shredding ring configured to be mounted to an inlet of the pump; and a cutting device configured to rotate about an axial direction and configured to be fixed to a shaft of the pump, the shredding ring comprising a top face, a bottom face, and a central opening extending from the top face to the bottom face and being delimited in a radial direction by an inner periphery, a plurality of slots extending in the axial direction formed in the inner periphery, the cutting device being positioned in the central opening of the shredding ring, and comprising a front face and a back face, the front face comprising a plurality of first cutting members extending in the axial direction and facing the plurality of slots in the inner periphery, the back face of the cutting device comprising exactly two second cutting members projecting beyond the central opening with respect to the radial direction, the exactly two second cutting members being arranged diametrically opposite at an outer periphery of the cutting device.

2. The shredding assembly in accordance with claim 1, wherein the at least one second cutting member comprises a leading face inclined with respect to the axial direction at a rake angle of 40° to 60.

3. The shredding assembly in accordance with claim 1, wherein the at least one second cutting member comprises a leading edge inclined with respect to the radial direction at a cutting angle of 35° to 55°.

4. The shredding assembly in accordance with claim 1, wherein the slots are configured and arranged such that only one of the two second cutting members performs a cutting action at any moment in time during operation.

5. The shredding assembly in accordance with claim 1, wherein the plurality of first cutting members comprises at least one recess at the outer periphery of the cutting device, the recess forming a cutting edge.

6. The shredding assembly in accordance with claim 1, wherein the plurality of first cutting members comprises at least one protrusion extending from the front face of the cutting device in the axial direction.

7. The shredding assembly in accordance with claim 6, wherein the at least one protrusion comprises a leading face inclined with respect to the radial direction at a front angle of 20° to 26°.

8. The shredding assembly in accordance with claim 6, wherein the at least one protrusion comprises a leading face inclined with respect to the radial direction at a front angle of 23°.

9. The shredding assembly in accordance with claim 6, wherein the at least one protrusion comprises a leading face inclined with respect to the radial direction at a front angle of 18° to 28°, and the leading face of the protrusion is inclined such that a radially outer edge delimiting the leading face is ahead of a radially inner edge delimiting the leading face, when viewed in the direction of rotation.

10. A centrifugal grinder pump comprising:

a housing including the inlet for a fluid to be conveyed, and a pump outlet for discharging the fluid;

at least one impeller configured to rotate about the axial direction with the impeller being arranged in an impeller chamber;

the shaft configured to rotate the impeller; and the shredding assembly according to claim 1 arranged at the inlet and configured to shred constituents of the fluid, the shredding ring mounted to the inlet of the pump, the cutting device connected to the shaft, and the bottom face of the shredding ring and the back face of the cutting device arranged to face the impeller chamber.

11. The centrifugal grinder pump in accordance with claim 10, wherein the centrifugal grinder pump is a multistage centrifugal pump, the at least one impeller comprising first and second stage impellers and the impeller chamber being a first impeller chamber and the centrifugal grinder pump including a second impeller chamber, the first stage impeller arranged in the first impeller chamber, and the second stage impeller arranged in the second impeller chamber, and centrifugal grinder pump further comprising a diffusor configured to guide the fluid from the first impeller chamber to the second stage impeller with the diffusor being arranged between the first stage impeller and the second stage impeller in the axial direction, the first stage impeller and the second stage impeller connected to the shaft in a torque-proof manner.

12. The centrifugal grinder pump in accordance with claim 11, wherein the diffusor is a disk-shaped diffusor delimiting both the first impeller chamber and the second impeller chamber with respect to the axial direction.

13. The centrifugal grinder pump in accordance with claim 11, further comprising a drive unit configured to rotate the shaft about the axial direction, the drive unit arranged within the housing, and the first stage impeller and the second stage impeller arranged between the drive unit and the shredding assembly with respect to the axial direction.

14. The centrifugal grinder pump in accordance with claim 13, wherein the centrifugal grinder pump is configured for a vertical operation with the shaft extending in a vertical direction, the drive unit arranged above the first stage impeller and the second stage impeller.

15. The centrifugal grinder pump in accordance with claim 10, wherein, the centrifugal grinder pump is a submersible pump.

16. The centrifugal grinder pump in accordance with claim 10, wherein the centrifugal grinder pump is a two stage pump.

17. The shredding assembly in accordance with claim 1, wherein the at least one second cutting member comprises a leading face inclined with respect to the axial direction at a rake angle of 45° to 55°.

18. The shredding assembly in accordance with claim 1, wherein the at least one second cutting member comprises a leading face inclined with respect to the axial direction at a rake angle of 50°.

* * * * *